United States Patent [19]

Hore

[11] Patent Number: 4,461,092

[45] Date of Patent: Jul. 24, 1984

[54] SET SQUARE

[75] Inventor: Donald L. Hore, Bristol, England

[73] Assignee: Paraflux Limited, Bristol, England

[21] Appl. No.: 372,085

[22] Filed: Apr. 26, 1982

[51] Int. Cl.[3] ..... B43L 13/00

[52] U.S. Cl. ..... 33/474; 33/174 B

[58] Field of Search ..... 33/429, 474, 477, 174 G, 33/174 B, 476, 27 R

[56] References Cited

U.S. PATENT DOCUMENTS

| | | | |
|---|---|---|---|
| 1,171,329 | 2/1916 | Early | 33/477 |
| 2,610,407 | 9/1952 | McQuaid, Sr. | 33/474 |
| 4,345,383 | 8/1982 | Corsette | 33/474 |

FOREIGN PATENT DOCUMENTS

| | | | |
|---|---|---|---|
| 585040 | 9/1933 | Fed. Rep. of Germany | 33/474 |
| 1208614 | 2/1960 | France | 33/474 |
| 205209 | 6/1939 | Switzerland | 33/474 |

OTHER PUBLICATIONS

"Trigonaut" Publication of Applicant's Commercial Embodiment.

*Primary Examiner*—Willis Little
*Attorney, Agent, or Firm*—Larson and Taylor

[57] ABSTRACT

A set square has substantially the form of a 30°/60°/90° triangle having therein an aperture having sides at 15° and 45° to each external side. The aperture may be in the form of a 30°/30°/120° triangle disposed with its longest side closest to the hypotenuse of the 30°/60°/90° triangle and at an angle of 15° thereto, said side diverging from the hypotenuse towards the 30° vertex of the 30°/60°/90° triangle; preferably a line is indicated perpendicular to one of the external sides other than the hypotenuse, the line being indicated adjacent said side and extending across said aperture, and being indicated on either side thereof. There may be a protractor scale whose origin is at the intersection of the line and the perpendicular side.

10 Claims, 3 Drawing Figures

A
B
C
a
b
c
X
Y
Z
x
y
z
-2'-

10
X
Y
9

A
B
C
a
b
c
P
Q
R
p
q
r
X
Y
-2-
1
3
4
5
6
7
8
9
30°
60°
90°
15°
45°
75°

SET SQUARE

BACKGROUND OF THE INVENTION

The present invention relates to a set square.

Set squares in general are well-known. The usual form is that of a right angled triangle whose other angles are both 45° or are 60° and 30°. The square is commonly made of a plastic material or metal.

Numerous proposals have been made to render set squares more versatile. However none of these seems to have had any success. This is probably because they either add little to the potential utility of the square, or because they are so complicated as to frighten off potential users and/or to increase manufacturing costs substantially.

For example, U.S. Pat. No. 2,043,729 (Bilder) discloses a 90°/45°/45° set square having three cut-outs which provide various straight edges at predetermined angles to external edges. There are also numerous apertures for use in drawing circles, and a protractor scale. The whole is of dauntingly complicated appearance, and would apparently require much practice to master. U.S. Pat. No. 1,598,690 (Petronio) discloses a 90°/60°/30° set square with three apertures (a slot and two triangles) for providing further angles. The triangles are right-angled, with the perpendicular sides parallel to those of the set-square. Thus only the hypotenuses provide additional angles. Generally, a given angle is obtainable only relative to one particular external side. Thus the user must locate the square the correct way up, and select the correct aperture. There is also a protractor scale, symmetrical about the 90° angle of the square, its origin indicated by an aperture.

Further examples of patent specifications disclosing modified set-squares are:

French No. 908163 (Vardanian)
French No. 934943 (Le Material Automatique Electrique)
French No. 957869 (Lewin)
French No. 981857 (Cordani)
French No. 1124247 (Balloche)
French No. 1208614 (Hoellinger)
French No. 2351801 (Bord)
U.S. Pat. No. 1,845,449 (Smith)
U.S. Pat. No. 3,375,589 (Dolgorukov)
Swiss No. 276736 (Clerc)
G.B. No. 794192 (Midulla)

SUMMARY OF THE INVENTION

According to the present invention there is provided a substantially triangular set square having three external straight edge portions with angles of 30°, 60° and 90° defined by respective pairs thereof, and an internal substantially triangular aperture having respective straight edge portions which define angles of 15° and 45° with each of the external straight edge portions.

By means of such a set square, a draughtsman using a T-square can set the four usual angles (30°,45°,60°,90°), and also obtain angles of 15° and 75°.

Preferably the straight edge portions of the aperture define a 30°, 30°, 120° triangle. Then a user, even without a T-square, can set angles precisely. Angles can be drawn easily and accurately, particularly interior angles of the aperture, but also angles formed by one side of the cut-out and one external edge portion. Use of the interior angles to draw vertices is of course not affected by the degradation of the external corner portions of the square, which commonly happens in use.

Preferably there are means indicating a straight line at right-angles to one of the external straight edge portions other than that defining the hypotenuse, said line traversing the aperture. This line can be used to set 45°, 60°, 75° and 90° angles precisely, without the need for a T-square. The line is then used as a reference instead of an external edge/portion.

Preferably there are means defining a protractor scale arranged so that the origin of the protractor is at the intersection of said line and the straight edge portion at right angles thereto, said line indicating the 90° line of the protractor. Having the origin of the protractor at the edge makes the protractor particularly simple to use, e.g. for setting the square at any desired angle to a given line.

The versatility of the implement can be increased by providing one or more of the edge portions with measuring scales and/or by providing a plurality of holes at predetermined spacings for receiving pencil points for drawing arcs of predetermined radii.

There may be indicia indicating the angular relationships of at least some of the straight edge portions.

Some preferred embodiments of the invention will now be described by way of example with reference to the accompanying drawings, in which.

Figure 1:
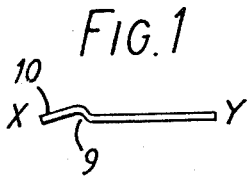
FIG. 1 is a plan view of a preferred embodiment of a set square according to the invention.
Figure 2:
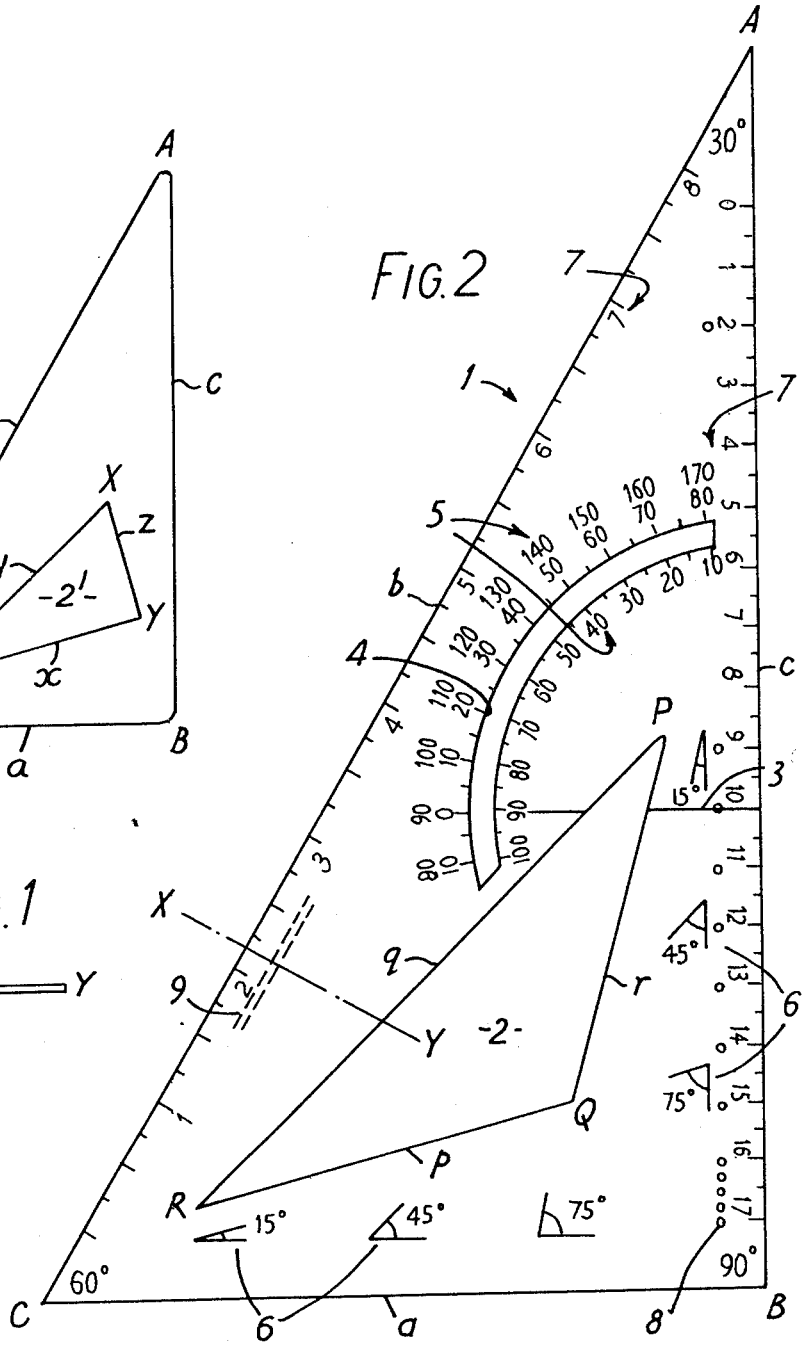
FIG. 2 is a section along XY in FIG. 1.

The set square 1 shown in FIGS. 1 and 2 has the general form of a 30°/60°/90° triangle ABC, having sides a and c at right angles, and side b as hypotenuse. Angles A and C are 30° and 60° respectively. An aperture 2 has the form of a 30°/30°/120° triangle PQR, the sides p and r and the angles P and R being equal. It is oriented so that its longest side q is adjacent the hypotenuse b, and makes an angle of 15° therewith, approaching nearer it towards the vertex C.

Thus, the single cut-out 2 provides angles of 15° and 45° to each external side a,b,c as follows:

| External Side | Side forming angle of 15° | Side forming angle of 45° |
|---|---|---|
| a | p | q |
| b | q & r | p |
| c | r | q |

Angles of 75° to sides a and c are also provided, by sides r and p respectively.

As indicated at 6, the square 1 may bear indicia for showing the user where to obtain various angles.

A line 3 is indicated (suitably by an inked indentation), extending at right angles to edge c from a point 0 thereon. The line 3 is interrupted by the aperture 2, and continues on the other side thereof until it reaches an arcuate slot 4 furnished with protractor scales 5. The slot and scales have their centre of origin at 0. The edge c and the line 3 are respectively the 0°/180° and 90° lines of the protractor. Thus the square 1 can easily be positioned at any desired angle to a given line. Although the slot 4 extends only over about 95°, angles up to 180° can be measured or set by using either the edge c or the line 3 as the reference line. Having the line 3 traverse the aperture 2 makes it easy to align with a line on a drawing even if the square 1 is opaque.

The longer external sides b,c are provided with scales 7 graduated in inches and centimeters respectively. Adjacent side c is a line of small apertures 8: five with 2 mm spacings, seven more at 1 cm spacings, and another 7 cm from the last of these. The apertures 8 are dimensioned to receive pencil points with minimal play, so that arcs of known radii can be drawn using two pencils.

This instrument design does not necessitate transparency, and it may be manufactured in any suitable material such as metal or plastics by any conventional means. If sheet metal or plastics is to be used, section X-Y in FIG. 2 shows typically how its structure can be stiffened to minimise the material thickness and weight, and also provide additional benefits. A fold 9 can be pressed or moulded all round the periphery of the instrument, resulting in bevelled edges 10 for the scales 7. This not only provides stiffening, but improves the appearance, and also enables the instrument to be used face down with advantage when using pen and ink, to discourage running of the ink as may occur with a flat surface against the paper.

Figure 3:
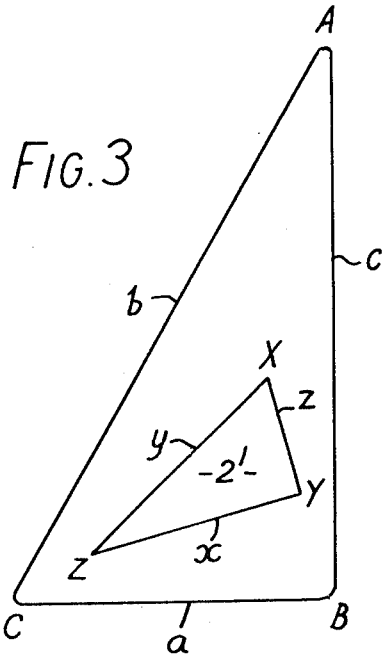
FIG. 3 is a schematic view of a second embodiment.

Although the arrangement shown in FIG. 1 is felt to be particularly useful, others are possible and may be favoured in some circumstances. Other shapes and orientations of the aperture 2 are possible, while still giving the desired angles with the external sides. Thus FIG. 3 shows an alternative arrangement with an aperture 2' formed as a 30°/60°/90° triangle XYZ with sides x,y,z. The hypotenuse y is at 15° to side b, and 45° to side a. The shortest side z is at 15° to side c, and 45° to side a. The other side x is at 15° to side a and 45° to side b.

While the invention has been illustrated above with reference to preferred embodiments, those skilled in the art will understand that various changes may be made without departing from the spirit and scope of the invention, and it is intended to cover all such changes and modifications by the appended claims.

I claim:

1. A substantially triangular set square having three external straight edge portions whereof first and second edge portions define an angle of 60°, second and third edge portions define an angle of 30°, and the third and first edge portions define an angle of 90°: said square having an internal substantially triangular aperture having three internal straight edge portions whereof the first is at an angle of 15° to said first external edge portion and at angle of 45° to said second external edge portion, the second is at an angle of 15° to said second external edge portion and at angles of 45° to said first and third external edge portions: and the third is at an angle of 15° to said third external edge portion: whereby each external straight portion has a respective pair of internal edge portions at angles of 15° and 45° respectively.

2. A set square according to claim 1 wherein the straight edge portions of the aperture define a 30°,30°,120° triangle.

3. A set square according to claim 2 wherein the edge portion of the aperture which is opposite the 120° angle is at 15° to that external edge portion which defines the hypotenuse.

4. A set square according to claim 1 having means indicating a straight line at right-angles to one of the external straight edge portions other than that defining the hypotenuse, said line traversing the aperture.

5. A set square according to claim 4 further including means defining a protractor scale arranged so that the origin of the protractor is at the intersection of said line and the straight edge portion at right angles thereto, said line indicating the 90° line of the protractor.

6. A set square according to claim 1 wherein at least one of the straight edge portions is provided with a measuring scale.

7. A set square according to claim 1 wherein the set square is provided with a multiplicity of apertures at predetermined spacings for receiving pencil points for use in drawing arcs.

8. A set square according to claim 1 having a peripheral channel-section portion whose outer margin is arranged to form a bevelled edge of the square.

9. A set square according to claim 1 bearing indicia indicating the angular relationships of at least some of the straight edge portions.

10. A set square having substantially the form of a 30°/60°/90° triangle having therein an aperture substantially in the form of a 30°/30°/120° triangle disposed with its longest side closest to the hypotenuse of the 30°/60°/90° triangle and at an angle of 15° thereto, said side diverging from the hypotenuse towards the 30° vertex of the 30°/60°/90° triangle; said square further comprising means indicating a line extending parallel to a first side and perpendicular to a second side of the 30°/60°/90° triangle, said line being indicated adjacent said second side and extending across said aperture and being indicated on either side thereof; and means defining a protractor scale whose origin is at the intersection of said line and said second side.

* * * * *